US007543412B2

(12) United States Patent
Long et al.

(10) Patent No.: US 7,543,412 B2
(45) **Date of Patent: *Jun. 9, 2009**

(54) WALL PANEL EDGE RAIL CONNECTOR ARRANGEMENT

(75) Inventors: Darren R. Long, Calgary (CA); Nathan S. Shedd, Calgary (CA); Rupert Jakob-Bamberg, Calgary (CA); Kevin T. Domagala, Calgary (CA); Aaron D. Mullin, Calgary (CA); Vincent A. Shivak, Calgary (CA); Dale Marshall, Calgary (CA)

(73) Assignee: Haworth, Ltd., Calgary, Alberta (CA)

( * ) Notice: Subject to any disclaimer, the term of this patent is extended or adjusted under 35 U.S.C. 154(b) by 829 days.

This patent is subject to a terminal disclaimer.

(21) Appl. No.: 10/867,565

(22) Filed: Jun. 14, 2004

(65) Prior Publication Data

US 2005/0284094 A1 Dec. 29, 2005

(51) Int. Cl.
*E04B 2/00* (2006.01)

(52) U.S. Cl. ..... 52/127.11; 52/204.65; 52/207; 52/204.72; 52/767; 52/771

(58) Field of Classification Search ..... 52/204.65, 52/207.7, 204.72, 766, 767, 771, 770, 127.8, 52/127.11, 127.12, 278, 207
See application file for complete search history.

(56) References Cited

U.S. PATENT DOCUMENTS

| | | | | |
|---|---|---|---|---|
| 2,708,013 | A * | 5/1955 | Kullmer | 52/770 |
| 2,795,305 | A | 6/1957 | Bagge | |
| 2,805,739 | A * | 9/1957 | Dennison | 52/127.12 |
| 3,267,631 | A * | 8/1966 | Hammitt | 52/771 |
| 3,430,997 | A | 3/1969 | Propst et al. | |
| 4,635,422 | A | 1/1987 | Nowack et al. | |
| 4,786,201 | A | 11/1988 | Huetter et al. | |
| 4,999,958 | A | 3/1991 | Harrison | |
| 5,363,612 | A | 11/1994 | Erickson | |
| 5,625,991 | A | 5/1997 | Sturrus | |
| 5,636,484 | A | 6/1997 | DeBlock | |
| 6,421,968 | B2 | 7/2002 | Degelsegger | |
| 2007/0137124 | A1 * | 6/2007 | MacDermott et al. | 52/278 |

* cited by examiner

*Primary Examiner*—Richard E Chilcot, Jr.
*Assistant Examiner*—Matthew J Smith
(74) *Attorney, Agent, or Firm*—Flynn, Thiel, Boutell & Tanis, P.C.

(57) ABSTRACT

A pair of upright wall panels are each provided with a sidewardly spaced pair of generally parallel but inclined guide grooves extending vertically along the outer face of the upright frame edge rails. A connector assembly including a main activator rod having a pair of wedge members threaded thereon in spaced relationship therealong is positioned between the opposed upright edge rails. The wedge members have wedgelike edge flanges which protrude into the grooves of the opposed upright edge rails. Rotation of the activating rod causes the wedge members to simultaneously move relative to the rod in opposite directions to effect gripping engagement with the groove walls to simultaneously effect a drawing together of the edge rails and alignment thereof.

20 Claims, 3 Drawing Sheets

WALL PANEL EDGE RAIL CONNECTOR ARRANGEMENT

FIELD OF THE INVENTION

This invention relates to an upright wall panel arrangement, including prefabricated wall panels defined by a large glass panel disposed within a surrounding supporting frame, and more specifically relates to an improved hidden connector arrangement compactly disposed between opposed upright edge rails of adjacent panels for drawing adjacent panels together in aligned relationship.

BACKGROUND OF THE INVENTION

Prefabricated upright panels of the type utilized for dividing interior workspaces are rigidly interconnected utilizing a wide range of connector structures which, in many instances, are constructed so as to be hidden in use, but which are often difficult to access. In many instances access to such connectors is vertically from above, and in such instance such connector is normally feasible for use only with panels which are less than floor-to-ceiling height. Additionally, many of the connectors which are accessible from the sides of the panels are, if uncovered, visually distracting, and hence such wall panels require additional auxiliary covers for hiding the connectors and improving the appearance of the assembled wall. The type and nature of connector also is a function of the type of construction of the prefabricated wall panel and, in some instances, such as when the panel is defined dominantly by a vertically enlarged glass panel having a surrounding edge frame, the provision of an adequate connector for joining adjacent upright panels is further complicated by the limited available space provided by the edge frames of the panels. In many instances, particularly when the panels are of the type referred to as "glass" panels, the frames of adjacent upright panels are frequently connected by vertically elongate splines connected between opposed vertical edges of the panel frames, or alternatively the adjacent vertical edges of the panel frames are joined by threaded fasteners extending therebetween. Such arrangements, however, have proven troublesome with respect to their ability to effect proper drawing together of the panels and at the same time maintain desired aligned relationship between the panels.

It is an object of this invention to provide an interior upright wall arrangement employing an improved connector assembly which cooperates between adjacent upright edge rails of adjacent panels for effecting secure drawing together of prefabricated panels in aligned relationship, and at the same time enabling the connector assembly to be effectively visually hidden between the adjacent upright edge frames while still being readily accessible for permitting the edge frames of the panels to be either joined together or disconnected when desired.

In the upright wall panel arrangement of the present invention, a pair of vertically large upright wall panels, each generally preassembled and provided with a surrounding rigid frame, are provided with a sidewardly spaced pair of generally parallel but inclined guide grooves extending vertically along the outer face of the upright frame edge rails. A connector assembly including a main activator shaft or rod having a pair of wedge nuts threaded thereon in spaced relationship therealong is positioned between the pair of opposed upright edge rails associated with a pair of adjacent panels. The wing nuts, which are oppositely threadedly engaged on the activating rod, have wedgelike edge flanges which protrude into the grooves of the opposed upright edge rails.

Rotation of the activating rod, as by inserting a activating tool through a narrow upright slot defined between the adjacent edge rails, causes the wedge nuts to be simultaneously moved relative to the rod and in opposite directions with respect to one another so as to effect gripping engagement with the cam slots of the opposed edge rails so as to simultaneously effect not only a drawing together of the edge rails, but also an alignment thereof to hence effect a fixed and aligned securement of the adjacent panels to one another. The connector assembly remains trapped between the opposed adjacent edge rails and is accessible for release by insertion of a small tool, such as an Allen wrench, through the narrow slot. The narrow slot can be conveniently closed by inserting a plastic trim strip therein.

Other objects and purposes of the invention will be apparent to persons familiar with constructions of this type upon reading the following specification and inspecting the accompanying drawings.

Figure 1:
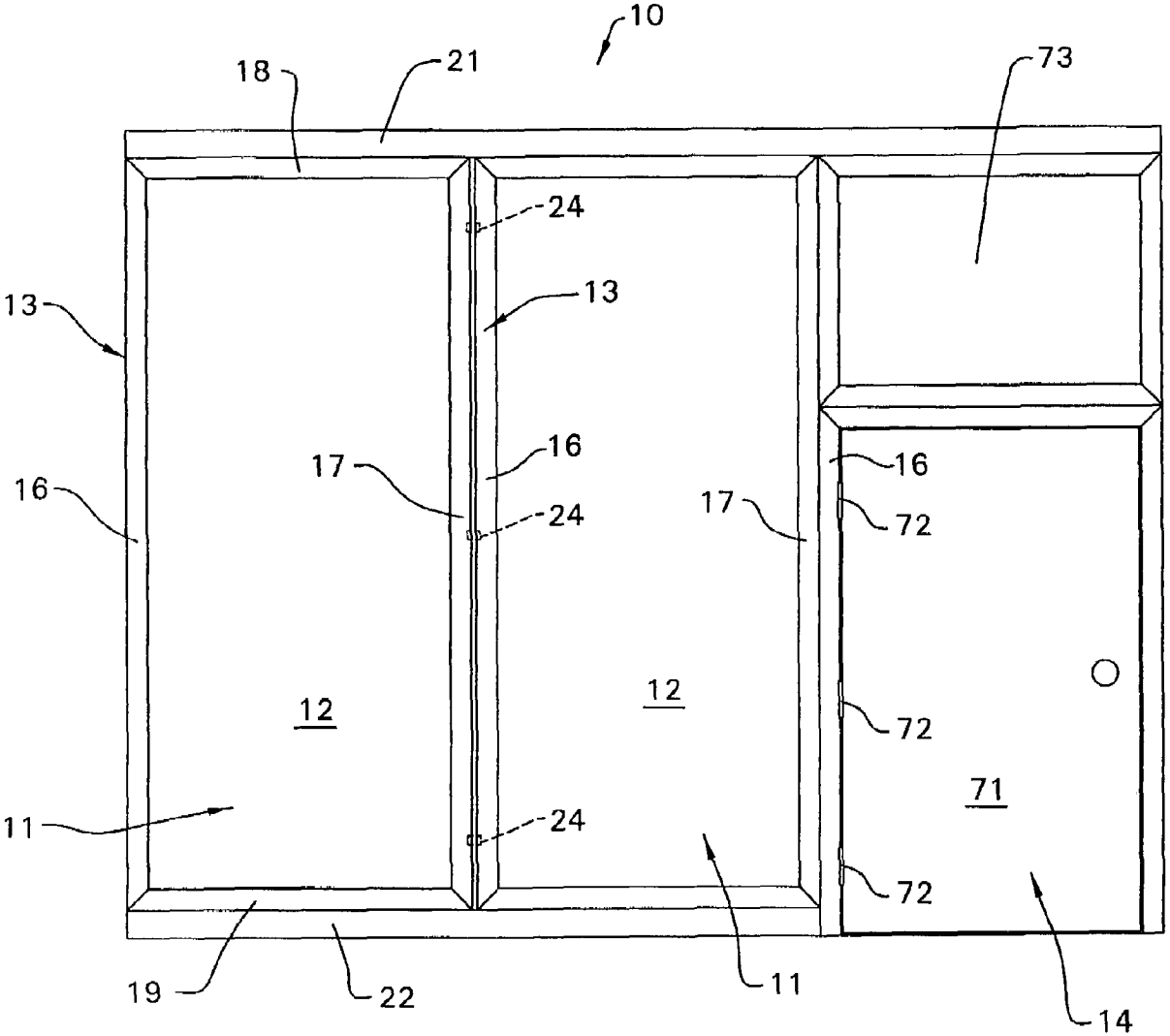
FIG. 1 is a front elevational view illustrating part of an upright interior wall system which, in this diagrammatic illustration, includes three upright panels disposed in adjacent, aligned and fixedly interconnected relationship to one another.

Certain terminology will be used in the following description for convenience in reference only, and will not be limiting. For example, the words "upwardly", "downwardly", "rightwardly" and "leftwardly" will refer to directions in the drawings to which reference is made. The words "upper" or "upward" will also be used in reference to the normal orientation of the wall arrangement, which orientation results in the upper edge of the wall as illustrated in FIG. 1 being generally disposed in close proximity to a ceiling. Said terminology will include the words specifically mentioned, derivatives thereof, and words of similar import.

DETAILED DESCRIPTION

Figure 2:
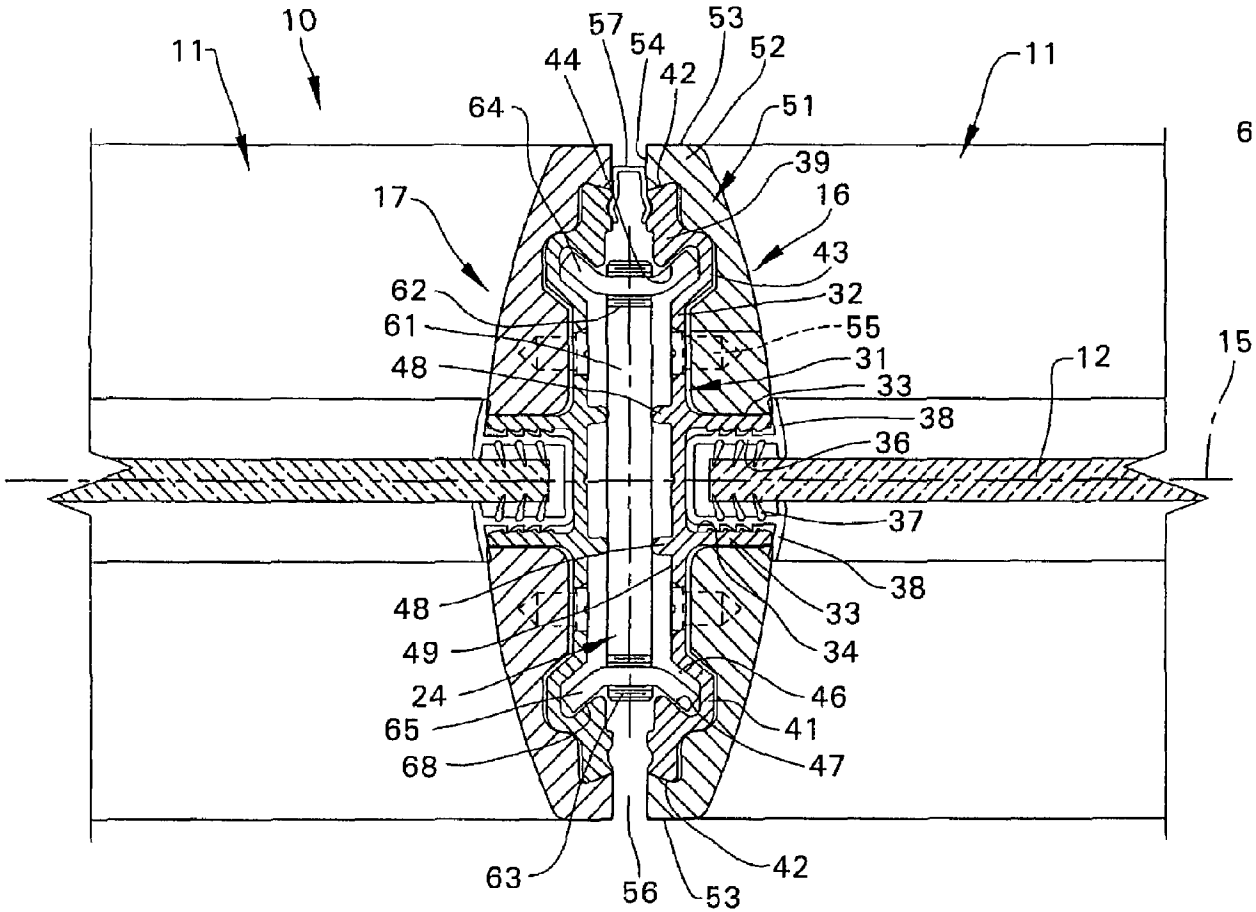
FIG. 2 is an enlarged fragmentary cross-sectional view taken generally along line II-II in FIG. 1 and illustrating the construction of the edge frames of the panels and their connection by a connector assembly disposed therebetween.

Referring to FIG. 1, there is diagrammatically illustrated an upright wall arrangement 10 of the type intended for dividing large interior spaces into smaller workspaces, such as for offices and the like. The upright wall arrangement 10 in the illustrated embodiment illustrates a pair of upright and generally rectangular wall panel assemblies 11 which as illustrated are generally identical, although it will be appreciated that such wall panel assemblies do typically come in a significant number of widths so that different width wall panel assemblies can be coupled together. In addition, while FIG. 2 illustrates a pair of wall panel assemblies 11 joined in adjacent and aligned relationship, it will be appreciated that any number of such panel assemblies can be joined together to define a wall arrangement. One of the wall panel assemblies, as indicated at 14 in FIG. 1, may be formed to define a door assembly, as discussed hereinafter.

The wall panel assembly 11 includes a primary center panel or core 12 which defines the primary vertical and horizontal extent of the panel assembly. This center panel 12 is supported by a surrounding exterior frame 13 which engages and extends along the peripheral edges of the center panel 12.

The frame 13, in a generally conventional manner, is defined by generally parallel, upright side edge frame rails 16 and 17 which define opposite side edges of the panel assembly, and the upright frame rails 16 and 17 have opposite ends thereof rigidly joined together by generally parallel top and bottom edge frame rails 18 and 19 which extend generally perpendicularly between and join to the respective ends of the side edge rails 16 and 17, whereby the frame hence is generally rectangular and supportingly surrounds the center panel 12.

The wall panel assemblies 11, in the preferred and illustrated arrangement, are of sufficient vertical height to effectively function as floor-to-ceiling panels, and for this purpose the wall panel assembly typically has the upper edge thereof supportingly engaged with a horizontally elongate top support rail 21, the latter typically being fixed to the ceiling. The bottom of the wall panel assembly 11 is in turn typically supported on a horizontally elongate bottom support rail 22 which may optionally be fixed to the floor or, when the floor is covered with carpeting or the like, the bottom rail may be provided with grippers for engaging the carpet.

To connect a pair of upright wall panel assemblies 11 in rigid, adjacent and aligned edge-to-edge relationship (i.e., the aligned panels are substantially vertically coplanar), as diagrammatically illustrated in FIG. 1, the wall arrangement 10 of the present invention utilizes a plurality of vertically-spaced connector assemblies 24 (FIG. 2) for rigidly coupling the opposed and adjacent upright frame rails, namely the side edge frame rail 16 on one panel assembly and the adjacent side edge frame rail 17 of the adjacent panel assembly, in adjacent, aligned and rigid relationship. The construction of the connector assembly 24, and its cooperation with the adjacent side edge rails, will be explained in greater detail hereinafter.

Considering first the construction of the side edge rails 16 and 17, these rails are basically mirror images of one another and, in the FIG. 2 embodiment, are identical to one another. The following will hence relate solely to the rail 16 for convenience in description since the rail 17 also possesses identical parts.

More specifically, and referring to FIG. 2, the upright edge frame rail 16 includes an upright edge member 31 which extends vertically throughout substantially the full height of the wall panel assembly, which edge member 31 in this embodiment is formed preferably as a one-piece aluminum extrusion. The edge member 31 is defined principally by a main upright center wall 32 of a platelike construction which extends in the transverse or thickness direction of the wall panel assembly. This main center wall 32 has, on the inner side thereof, a pair of generally parallel side flanges 33 which project inwardly in generally perpendicular relationship from the center wall 32 and which cooperate with the center wall 32 to define a generally inwardly opening U-shaped channel 34. This channel 34, which in this embodiment is positioned so that the center plane thereof is disposed generally on the vertical center plane 15 of the wall panel assembly, accommodates therein a generally U-shaped glazing strip 36 which effectively lines the channel 34 and extends vertically therealong. This glazing strip 36, which is of a plastic or other suitable material having at least limited resiliency, has a plurality of resilient tabs 37 cantilevered inwardly from the opposed inner side walls for resilient gripping engagement with opposite side surfaces of the edge portion of the center core panel 12 which, in this preferred embodiment, is a large platelike glass panel. The glazing strip 36, at the outer edges of the side legs thereof, has transversely projecting trim flanges 38 joined thereto, the latter projecting transversely so as to engage the side face of the glass panel 12 and at the same time effectively visually close the glazing strip and its supporting channel.

The upright edge member 31 also includes, on opposite sides of and spaced outwardly from the channel 34, a pair of enlarged edge parts 39 and 41. These edge parts 39 and 41 are enlarged in cross section relative to the center wall part 32, and extend vertically along the upright edge member 31 adjacent but spaced slightly inwardly from opposite side edges of the frame rail 16. The edge parts 39 and 41 each terminate in an outer free edge 42 which defines the outer upright edge of the member 31. The spacing between the edges 42 in this embodiment is slightly less than the overall transverse width of the frame as defined, for example, by the width of the upright frame rail 16.

The enlarged edge part 39 defines therein a groove 43 which opens inwardly from the outer surface 49 of the edge member, which outer surface 49 is the exposed edge surface of the prefabricated wall panel assembly prior to such panel being rigidly secured in aligned relationship to other similar wall panel assemblies. The groove 43 is elongated vertically throughout the length of the edge member 31 and, on at least one side thereof, defines a side wall 44 which is generally flat in the preferred embodiment, and which extends inwardly away from the edge wall 49 in angled but non-perpendicular relationship relative to the central upright plane 15 of the wall panel assembly.

The other enlarged edge part 41 has a similar groove 46 which extends vertically throughout the length of the rail member 31 and opens inwardly from the outer edge surface 49. The groove 46 defines a wall 47 on at least one side thereof which in the preferred embodiment is also flat and which angles as it projects away from the edge surface 49, which surface 49 angles in non-perpendicular relationship relative to the center upright plane 15.

The grooves 43 and 46 are preferably substantially identical to but mirror images of one another relative to the center upright plane 15. In this disclosed arrangement, the sloped side surfaces 44 and 47 of the grooves, which effectively function as gripping and wedging surfaces as explained hereinafter, are defined as the outer side surfaces of the respective grooves, and these side surfaces as they project away from the generally flat outer edge surface 49 toward the bottom of the respective groove are sloped or angled outwardly generally toward the respective exposed upright side surfaces of the wall panel assembly. The side or wedging surfaces 44 and 47, in the illustrated and preferred embodiment, preferably slope (i.e. toward the bottom of the respective closed groove) at an angle in the range of about 20° to about 40°, preferably about 30°, relative to the central vertical plane 15.

The pair of sloped side surfaces 44 and 47 as described above, are defined as the outermost side wall of the respective grooves and diverge away from one another as the side walls project toward the bottom of the respective grooves, and such represents a preferred configuration for the grooves and their cooperation with the connector assembly 24 as described in greater detail hereinafter. It will be recognized, however, that the pair of grooves could be provided with sloped surfaces on the inner side walls thereof, which sloped surfaces would function as the wedging surfaces and would be oppositely inclined relative to the slope provided when the outer side surfaces are the wedging surfaces as disclosed.

The upper edge member 31, as illustrated in FIG. 2, also has a pair of small but generally parallel ribs 48 cantilevered outwardly in sidewardly spaced relation from the outer edge surface 49 and extending vertically generally throughout the lengthwise extent of the edge member 31. The ribs 48 are preferably rounded at the outer free ends and effectively function as positioning stops which engage the connector assembly 24 when the latter connects adjacent panel assemblies in fully assembled relationship.

The upright edge frame rail 16, in the embodiment of FIG. 2, includes not only the upright edge member 31 but also includes a pair of vertically elongate trim strips 51 which overlie the inner surface of the edge member 51, on opposite sides of the glass pane 12, for providing a more desirable appearance. The trim strips 51 can be of wood or other suitable material, such as molded of a synthetic resin, and basically extend from one of the channel side flanges 33 outwardly so as to overlie the edge member 31 and terminate in an edge part 52 which defines the outer exposed side edge of the frame rail 16. This edge part 52 effectively wraps around and overlies the outer edge 42 of the edge member 31, and hence defines thereon an outer side edge surface 53, the latter defining the side edge of the frame rail, and an end edge surface 54, the latter generally aligning with an adjacent edge surface defined on the edge member 31.

The trim strips 51 can be suitably secured to the edge member 31 in a conventional manner, and in the illustrated arrangement a plurality of fasteners such as screws 55 are provided for securing the trim strips 51 to the edge member 31.

The assembled edge frame rails 16 and 17 associated with a pair of prefabricated wall panel assemblies, when the latter are positioned in adjacent aligned relationship and fixedly interconnected by the connector assembly 24 as illustrated in FIG. 2, result in a small slot 56 being defined between the adjacent but opposed edge rails 16 and 17, which slot 56 opens transversely through the thickness of the wall assembly, and also extends generally vertically throughout the height thereof. This slot 56, which is preferably of very small horizontal width, such as for example about ¼ inch, can be suitably closed at one or both sides of the wall assembly by insertion of a suitable and typically resilient closure strip, often referred to as a light blocker, one such strip being illustrated at 57 in FIG. 2.

Considering now the connector assembly 24, same includes a generally horizontally elongated activating rod or shaft 61, the latter having a length which is less than the thickness of the edge frame rails 16 and 17 as defined between the side edge surfaces 53. The activating rod 61 is, in the illustrated embodiment, provided with threads 62 and 63 adjacent opposite ends thereof, which threads are of opposite hand, that is, one is a right hand thread and the other is a left hand thread.

Connector assembly 24 also includes a pair of clamping or gripping members 64 and 65 each having a generally flat center part 66 provided with a threaded center opening 69. The threaded openings 69 associated with the clamping members 64 and 65 are also of reverse thread direction, whereby the clamping members 64 and 65 are threadably engaged with the respective threads 62 and 63 associated with opposite ends of the activating rod 61.

Each clamping member 64-65 includes a pair of wing parts 67 which are cantilevered outwardly from opposite sides of the center part 66, and each of these wing parts 67 defines on at least one exterior side thereof an exterior contact or wedge surface 68 which is generally flat and elongated in the vertical direction, but which when viewed horizontally is angled or sloped as it projects away from the flat surface of the center part 66. The slope or angle associated with the wedge surface 68 preferably corresponds to the slope provided on the opposed groove side surface 44 or 47 with which the wedge surface 68 is adapted to cooperate.

In the preferred and illustrated embodiment, the clamping members 64 and 65 are formed from platelike material, preferably metal material such as steel or aluminum, with each clamping member being formed to have a generally rectangular outer profile, and the wing parts 67 being suitably bent so as to slope outwardly away from the center part 66, whereby the clamping member when viewed in horizontal cross section has a shallow channel-like configuration. The channel-like configurations of the clamping members 64 and 65, when the latter are threadably mounted on opposite ends of the activating rod 61, hence face in opposite directions, with these channel-like configurations opening outwardly in the illustrated and preferred embodiment. However, as discussed above relative to the grooves 39 and 43, the angularity of the grooves as well as the channel-shaped configuration of the clamping members can be reversed so that all face inwardly, rather than outwardly as illustrated in FIG. 2, in which case the wedging cooperation between the wedging members and the grooved side walls would take place at the inner side wall of the groove, rather than the outer side wall as in FIG. 2.

Figure 3:
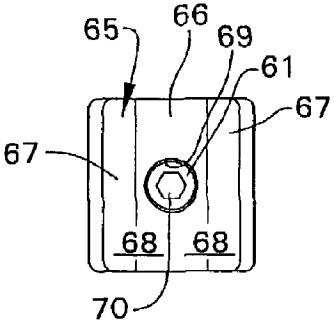
FIG. 3 is an end view of the connector assembly.

To manually activate the connector assembly 24, either to join adjacent panels or to disconnect adjacent panels, at least one end of the activator rod 61 is provided with a tool engaging part 70 (FIG. 3). The tool engaging part 70 in the illustrated embodiment comprises a tool-accommodating blind opening 70 which opens coaxially inwardly from one end of the rod 61. This opening 70 is preferably of hexagonal cross section and sized to accommodate one end of a standard Allen wrench which can be suitably inserted into the slot 56 between adjacent panels so as to engage the tool opening 70 to effect rotation of the activator rod 61.

The installation and operation of the connector assembly 24 for fixedly connecting and aligning adjacent wall panel assemblies will now be briefly described to ensure a complete understanding thereof.

More specifically, initially a pair of prefabricated wall panel assemblies 11 will be positioned in adjacent upright relationship so that the upright edge frame rails 16 and 17 of respectively adjacent wall panel assemblies are disposed in closlely adjacent but opposed relationship, generally as illustrated in FIG. 2, with the adjacent disposition of the wall panel assemblies providing the small clearance slot 56 between the opposed edge frame rails 16 and 17. A plurality of connector assemblies 24, disposed in vertically spaced relationship along the height of the clearance slot 56, are then utilized to provide a rigid securement between the adjacent frame rails 16 and 17 and to simultaneously effect alignment of the adjacent interconnected wall panel assemblies.

Assuming that the connector assembly 24 is in the desired vertical disposition between the opposed frame rails 16 and 17 so that the wing parts 67 associated with the gripping member 64 project into the opposed grooves 43, and the wing parts 67 associated with the gripping member 65 project into the opposed grooves 46, a tool such as an Allen wrench is inserted through the slot 56 so as to engage the tool opening 70 in the end of the activator rod 61, and is used to effect rotation of the activator rod 61. This rotation and the opposite-handed threaded connections to the gripping members 64 and 65 hence causes each of the gripping members 64 and 65 to be individually moved axially outwardly toward the adjacent free end of its respective thread, whereby the gripping members as a pair are hence moved axially away from one another, whereby the gripping or wedging surfaces 68 on the gripping members engage the sloped surfaces 44 and 47 defined on the outer side walls of the respective grooves. The engagement between these sloped surfaces on the grooves and the gripping members, in response to continued rotation of the activator rod 61 and continued outward movement of the gripping members 64 and 65, causes the opposed edge rail members 16 and 17 to be effectively pulled toward one another and also causes relative transverse (i.e. sideward) shifting of at least one of the side rails 16-17 relative to the other until they are properly aligned. This drawing in and aligning of the opposed frame rails 16 and 17 continues until the stops 48 defined on the opposed rails 16 and 17 effectively abut opposite sides of the activator rod 61, at which time the adjacent frame edge rail 16 and 17 are aligned and joined in desired positional relationship to one another.

Disassembly between the adjacent panels occurs in a reverse manner to that described above.

To effect positioning of the connector assemblies 24 between the adjacent edge frame rows 16 and 17, different techniques are available, two of which are briefly summarized below.

As one way of positioning the connector assemblies 24, the connector assembly may be positioned adjacent one of the edge rail assemblies 16 or 17 and temporarily secured thereto. For example, the connector assembly can be positioned adjacent the edge rail 16 substantially as illustrated in FIG. 2 so that the wing parts 67 on one side of the gripping members project into the slots 43 and 46. To do this type of positioning, however, the gripping members 64-65 are initially threaded inwardly away from the free ends of the rod so that the wing parts 67 can be moved transversely into the respective grooves, and for this purpose the grooves 43 and 46 are provided with a width in the axial direction of the rod 61 which is significantly greater than the thickness of the wing part, thereby allowing the wing part to be inserted straight into the groove. When so positioned the connector assembly 24 can then be temporarily secured to the rail assembly 16 such as by using a strip of adhesive tape (for example masking tape) for securing the rod 61 to the exterior edge surface 49 of the rail member 31. Thereafter the edge frame 17 of an adjacent panel is moved into an adjacent and generally aligned position so that the wing parts of the gripping member 64-65 are generally aligned with the slots 43 and 46 formed in the frame edge rail 17. When so positioned, the other wall panel assembly mounting the frame edge rail 17 thereon is then moved inwardly an additional distance towards the edge frame rail 16 so that the wing part enter into the grooves 43 and 46 of the edge frame rail 17. When so positioned, the activator rod 61 can then be rotated by a tool engaged in the opening 70 and, since the gripping members 64-65 and their projection into the pairs of opposed grooves 43 and 46 prevent the members 64-65 from rotating, these latter members are hence individually threaded outwardly into engagement with the sloped wedge surfaces 44 and 47, with continued rotation of activator rod 61 causing the gripping members 64-65 to create a tight clamping and aligning engagement with the opposed frame rails 16 and 17 in the manner described above.

As an alternate installation technique, the lower ends of the frame rails 16 and 17, adjacent at least one side of the wall panel assembly, can be provided with a small clearance opening (not shown) which is sized to permit the connector assembly 24 to be sidewardly inserted into the slot 56 so as to permit the gripping members 64-65 to align with the opposed pairs of slots 43 and 46. A small thin lifting member, such as the blade of a putty knife or screw driver, can be inserted into the slot 56 and positioned below the connector assembly 24 for engagement therewith, whereupon lifting of the blade upwardly along the slot 56 causes the connector assembly 24 to also be slidably moved vertically upwardly along the grooves until reaching the desired vertical position, at which time the activator rod 61 is rotated to effect movement of the gripping members 64-65 into gripping and aligning engagement with the sloped wedging side surfaces of the grooves.

Figure 4:
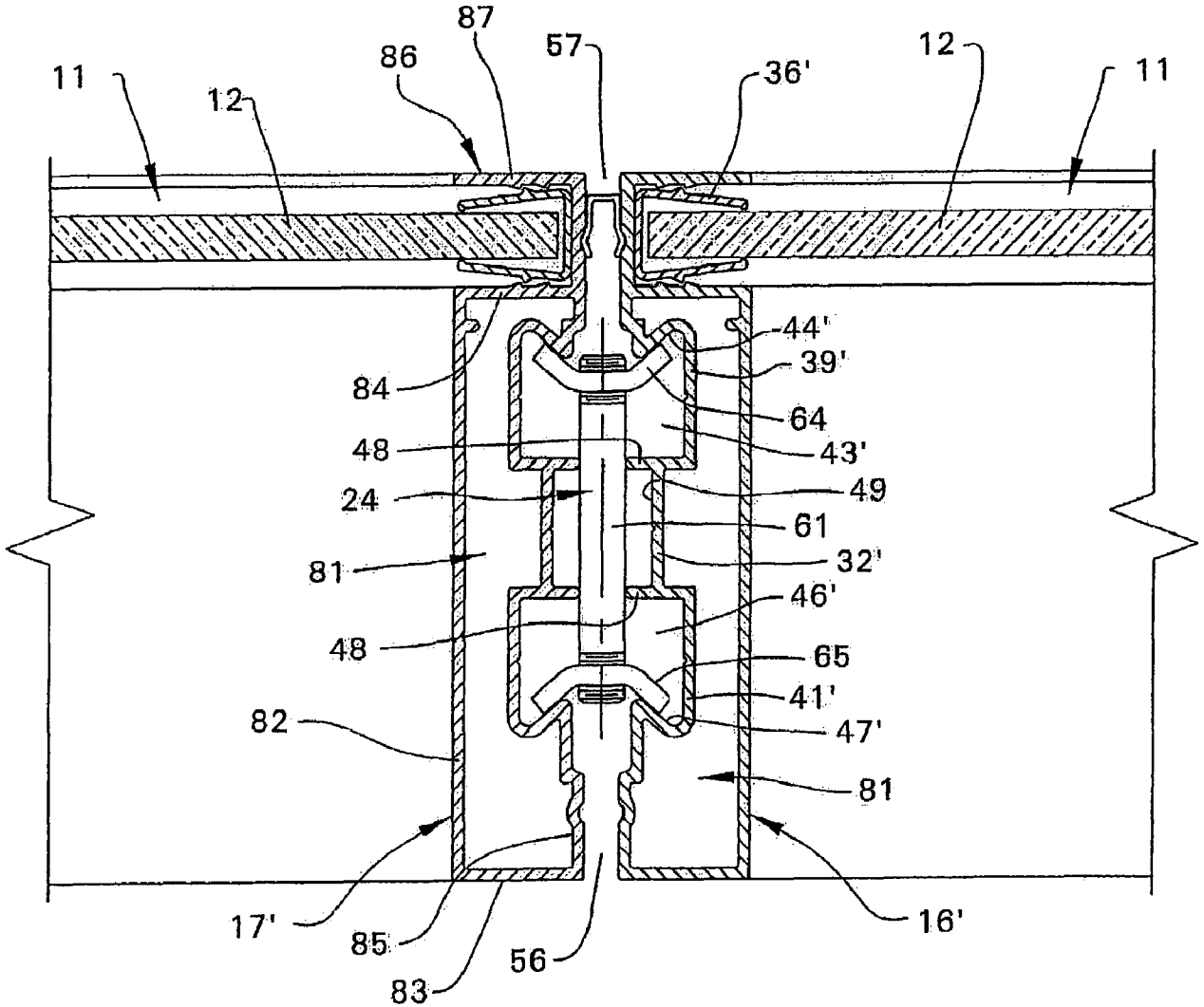
FIG. 4 is a view similar to FIG. 2 but illustrating a modified panel employing a modified edge member and its cooperation with the connector assembly.

Referring now to FIG. 4, there is illustrated a cross-sectional view which, while similar to FIG. 2, nevertheless illustrates a variation of the edge frame rails so as to permit mounting of the center panel or core 12 more closely adjacent one side of the prefabricated wall panel assembly. This latter positional relationship of the center panel 12 is often referred to as a "flush" mounting for the glass panel in that it is more closely adjacent one side of the wall panel assembly. In the embodiment shown in FIG. 4, many of the same structural and positional relationships associated with the FIG. 2 embodiment are still utilized, and hence parts of the FIG. 4 embodiment which correspond to those of FIG. 2 are designated by the same reference numeral with a ' (prime) added thereto so as to facilitate the description and understanding thereof.

In the FIG. 4 embodiment, each of the edge frame rails 16' and 17' is formed generally as an extruded one-piece vertically-elongate rail member and is formed to include a generally closed tubular profile section 81 which at one side is joined to an open channel profile section 86.

The tubular profile section 81 includes a transverse inner wall 82 which at opposite edges joins to two generally parallel side walls 83 and 84 which project horizontally and join to an outer edge wall 85 which extends transversely between the side walls 83 and 84 and hence effects closure of the tubular profile. This transverse outer edge wall 85 effectively defines thereon the main center wall 32' and the enlarged edge parts 39' and 41' at opposite sides thereof, the latter defining the vertically elongate but outwardly opening grooves 43' and 46'. These latter grooves again have slope or wedge surfaces 44' and 47' which cooperate with the gripping members 64 and 65 provided on the activating rod 61 of the connector assembly 24.

The channel profile 86 has one side thereof defined by the side wall 84 associated with the tubular profile, and it in turn cooperates with a generally parallel side wall 87 which defines one outer side surface of the frame rail 16' or 17', with the outer side surface of the frame rail being defined by the side wall 83 of the tubular profile 81. The parallel side walls 87 and 84 define an open channel therebetween which is closed by an extension of the outer edge wall 85, whereby the channel opens sidewardly and accommodates therein a conventional glazing channel 36', the latter providing for gripping engagement with an edge portion of a center panel 12, such as a platelike glass panel. This arrangement permits the glass panel 12 to be disposed in closely adjacent and hence generally flush relationship with respect to one exposed side of the assembled wall panel.

The cooperation of the connector assembly 24 with respect to the frame rails 16' and 17' is identical to the cooperation described above relative to the FIG. 2 embodiment, whereby further description thereof is believed unnecessary.

Referring again to FIG. 1, it will be noted that the wall arrangement 10 can have one of the panel assemblies, such as the assembly 14, formed to provide an openable door 71, such as a door which is swingable about conventional hinges 72. In such arrangement the door will be provided with vertical frames which again are generally formed so as to have the same exterior edge profiles as the frames 16 and 17 (or 16' and 17') so that the frame for the door can hence be coupled to the frame of the adjacent wall panel utilizing connector assemblies 24 in the same manner described above.

In addition, when a door is provided for association with the wall assembly 14 as illustrated in FIG. 1, a separate smaller panel 73 can additionally be provided for disposition above the door so as to extend upwardly to the ceiling. Such upper panel assembly 73 will again be formed so as to cooperate in the same manner as the panel assemblies 11 described above, and in fact the lower rail of the panel assembly 73, together with the upper rail of the door frame, can be provided with the same exterior edge profiles as illustrated in either FIG. 2 or 4 so as to permit the lower door frame and the upper panel 73 to be joined using a plurality of connector assemblies 24.

The top and bottom frame rails 18 and 19 as associated with the wall panel assemblies can be provided with profiles substantially identical to that illustrated by the side frame rails 16 and 17 in FIGS. 2 and 4 if desired. As an alternative, however, it will be recognized that the top and bottom frame rails can be of different and simpler profile if desired, such as by eliminating the grooves, inasmuch as such grooves are typically not utilized or necessary at either the top or bottom rail.

With the present invention, the wall panel assemblies are preferably fully fabricated and assembled prior to their being shipped to the job site, whereby upon receipt at the job site the installation of the wall panel assemblies and the joining together of such assemblies by the connector assemblies 24 hence greatly facilitates and expedites the creation of the desired upright wall.

The connector assembly 24 and its association with the upright edge rails provided on the panel assembly hence provides a highly desirable overall relationship in that it hence provides for a secure and relatively rigid joining of adjacent panels and ensures that the adjacent panels do effectively properly align as they are being adjacently rigidly joined, and at the same time the connector assemblies are effectively disposed entirely within the exterior wall profile (i.e., within the thickness of the wall as defined by the thickness of the edge frame rails), whereby the connector assemblies can be readily manually manipulated for both connecting or disconnecting adjacent wall panel assemblies, but at the same time the installed connector assemblies are effectively hidden and hence do not visually impact the exterior appearance of the assembled wall.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. An interior upright floor-to-ceiling wall arrangement, comprising:

at least first and second upright wall panels for supportive disposition on a floor and having a height which extends substantially to a ceiling and a width which extends horizontally in a widthwise direction, said first and second panels being positioned in adjacent and upright relationship so that the first and second panels are horizontally aligned in said widthwise direction thereof;

said first and second panels having respective first and second elongate upright edge rails disposed in closely adjacent but opposed relationship, said edge rails defining thereon edge faces of said panels which face outwardly and are in adjacent but opposed facing relationship;

a plurality of vertically spaced connector assemblies positioned horizontally between and fixedly but releasably engaged with said first and second edge rails for fixedly connecting said first and second panels together so as to be horizontally aligned in said widthwise direction;

each of said first and second edge rails having a pair of parallel elongate grooves disposed in sidewardly spaced relation and extending vertically along said rails and having a mouth opening outwardly of the respective edge face in said widthwise direction, the mouth of one of said grooves on said first edge rail being disposed horizontally opposite and substantially aligned with the mouth of one of the grooves on said second edge rail;

the pair of grooves of each said edge rail, as the grooves open inwardly from the respective edge face, defining a pair of oppositely sidewardly facing wedge faces which extend inwardly in angled relationship to one another;

said connector assembly including a connector member positioned between the horizontally opposed edge faces of said first and second panels and elongated horizontally in a thickness direction of the panels;

said connector assembly including a pair of transversely enlarged gripping members carried on said connector member in spaced relationship therealong, said gripping members being joined to said connector member by oppositely-handed threaded connections so that rotation of said connector member about its elongate axis causes the pair of gripping members to both move longitudinally in opposite directions relative to said connector member;

each said gripping member having a pair of monolithic wedge plates cantilevered outwardly from opposite sides thereof and defining thereon a pair of wedge surfaces which are in angled relationship to one another and engage said wedge faces defined on said grooves;

said connector member having a tool-engaging part defined at one end thereof for engagement with a tool insertable between the opposed edge faces for effecting rotation of the connector member;

whereby the connector assembly is positioned between the opposed edge faces of the first and second edge rails so that the wedge plates project into the pairs of opposed grooves, and rotation of the connector member causes the wedge plate to move lengthwise along said thickness direction in opposite distal directions relative to the connector member along said thickness direction so that the wedge surfaces engage the wedge faces and simultaneously cause the first and second panels to be aligned as they are drawn together in the widthwise direction.

2. A wall arrangement according to claim 1, wherein the opposed grooves on said first and second edge rails define a first opposed pair of grooves adjacent but spaced inwardly from one exposed upright side of the wall arrangement, and define a second opposed pair of grooves adjacent but spaced inwardly from the other exposed side of the wall arrangement.

3. A wall arrangement according to claim 1, wherein the connecting member is a horizontally elongate rod having a length less than the transverse width of the edge rails, said tool engaging part being defined at one end of said rod and positioned in inwardly spaced relation from the adjacent exposed exterior side of the wall arrangement, and said wedge plates surrounding and being threadably engaged on said rod adjacent opposite ends thereof.

4. A wall arrangement according to claim 1, wherein each of said first and second edge rails defines a U-shaped channel extending vertically therealong and opening horizontally inwardly from an inner surface thereof; and a large upright pane of glass having an upright edge portion thereof positioned within said U-shaped channel.

5. A wall arrangement according to claim 4, wherein said U-shaped channel is positioned generally at a middle of the edge rail relative to a horizontal thickness dimension of the panel and is disposed sidewardly between the adjacent pair of grooves as viewed in a thickness direction of the panel.

6. A wall arrangement according to claim 4, wherein the U-shaped channel is positioned adjacent one exterior side of the panel so that the glass pane is positioned more closely adjacent one exterior side surface of the panel, and wherein said channel is positioned sidewardly outwardly from the most closely adjacent of said pair of grooves.

7. A wall arrangement according to claim 1, wherein one of said upright panels includes a door which is horizontally hinged so as to be horizontally swingably movable relative to the respective edge rail.

8. A wall arrangement according to claim 1, wherein the opposed first and second edge rails have outer rail parts which are positioned closely adjacent but are horizontally spaced a small distance apart to define a narrow upright slot therebetween for accessing said connector assembly, and a removable resilient vertically elongate strip releasably fitted into said slot.

9. An interior upright floor-to-ceiling wall arrangement, comprising:

at least first and second upright wall panels for supportive disposition on a floor and having a height which extends substantially to a ceiling and a width which extends horizontally, said first and second panels being positioned in adjacent and upright relationship so that the first and second panels are horizontally aligned in a widthwise direction thereof;

said first and second panels having respective first and second elongate upright edge rails disposed in closely adjacent but opposed relationship, said edge rails defining thereon edge faces of said panels which are in adjacent but opposed facing relationship;

a plurality of vertically spaced connector assemblies positioned horizontally between and fixedly but releasably engaged with said first and second edge rails for fixedly connecting said first and second panels together in said horizontally aligned widthwise direction;

each of said first and second edge rails having a pair of parallel elongate grooves disposed in sidewardly spaced relation and extending vertically along said rails and having a mouth opening outwardly of the respective edge face, the mouth of one of said grooves on said first edge rail being disposed horizontally opposite and substantially aligned with the mouth of one of the grooves on said second edge rail;

the pair of grooves of each said edge rail, as the grooves open inwardly from the respective edge face, defining a pair of oppositely sidewardly facing wedge faces which extend inwardly in angled relationship to one another, the wedge face associated with each groove of each pair opening inwardly of the respective edge rail in angled relation relative to the horizontal widthwise direction of the aligned panels, and the wedge surface on each said wedge plate being angled relative to the horizontal widthwise direction of the aligned panels;

said connector assembly including a connector member positioned between the horizontally opposed edge faces of said first and second panels and elongated horizontally in a thickness direction of the panels;

said connector assembly including a pair of transversely enlarged gripping members carried on said connector member in spaced relationship therealong, said gripping member being joined to said connector member by oppositely-handed threaded connections so that rotation of said connector member about its elongate axis causes the pair of gripping members to both move longitudinally in opposite directions relative to said connector member;

each said gripping member having a pair of wedge plates cantilevered outwardly from opposite sides thereof and defining thereon a pair of wedge surfaces which are in angled relationship to one another and engage said wedge faces defined on said grooves;

said connector member having a tool-engaging part defined at one end thereof for engagement with a tool insertable between the opposed edge faces for effecting rotation of the connector member;

whereby the connector assembly is positioned between the opposed edge faces of the first and second edge rails so that the wedge plates project into the pairs of opposed grooves, and rotation of the connector member causes the wedge plate to move lengthwise in opposite directions relative to the connector member so that the wedge surfaces engage the wedge faces and simultaneously cause the first and second panels to be aligned as they are drawn together.

10. A wall arrangement according to claim 9, wherein the wedge surface extends in generally parallel relation to the respective wedge face with which it engages.

11. An interior upright floor-to-ceiling wall arrangement, comprising:

at least first and second upright wall panels for supportive disposition on a floor and having a height which extends substantially to a ceiling and a width which extends horizontally, said first and second panels being positioned in adjacent and upright relationship so that the first and second panels are horizontally aligned in a widthwise direction thereof;

said first and second panels having respective first and second elongate upright edge rails disposed in closely adjacent but opposed relationship, said edge rails defining thereon edge faces of said panels which are in adjacent but opposed facing relationship;

a plurality of vertically spaced connector assemblies positioned horizontally between and fixedly but releasably engaged with said first and second edge rails for fixedly connecting said first and second panels together in said horizontally aligned widthwise direction;

each of said first and second edge rails having a pair of parallel elongate grooves disposed in sidewardly spaced relation and extending vertically along said rails and having a mouth opening outwardly of the respective edge face, the mouth of one of said grooves on said first edge rail being disposed horizontally opposite and substantially aligned with the mouth of one of the grooves on said second edge rail;

the pair of grooves of each said edge rail, as the grooves open inwardly from the respective edge face, defining a pair of oppositely sidewardly facing wedge faces which extend inwardly in angled relationship to one another, said connector assembly including a connector member positioned between the horizontally opposed edge faces of said first and second panels and elongated horizontally in a thickness direction of the panels;

said connector assembly including a pair of transversely enlarged gripping members carried on said connector member in spaced relationship therealong, said gripping member being joined to said connector member by oppositely-handed threaded connections so that rotation of said connector member about its elongate axis causes the pair of gripping members to both move longitudinally in opposite directions relative to said connector member;

each said gripping member having a pair of wedge plates cantilevered outwardly from opposite sides thereof and defining thereon a pair of wedge surfaces which are in angled relationship to one another and engage said wedge faces defined on said grooves;

the grooves defining said one opposed pair having the wedge faces thereon projecting horizontally in oppositely angled relationship relative to the horizontal widthwise direction, and the wedge surfaces on the gripping member which engages the grooves of said first opposed pair also extending horizontally in oppositely angled relation relative to the horizontal widthwise direction;

said connector member having a tool-engaging part defined at one end thereof for engagement with a tool insertable between the opposed edge faces for effecting rotation of the connector member;

whereby the connector assembly is positioned between the opposed edge faces of the first and second edge rails so that the wedge plates project into the pairs of opposed grooves, and rotation of the connector member causes the wedge plate to move lengthwise in opposite directions relative to the connector member so that the wedge surfaces engage the wedge faces and simultaneously cause the first and second panels to be aligned as they are drawn together.

12. A wall arrangement according to claim 11, wherein the wedge surfaces of said wedge plates as engaged in opposed grooves of said opposed first pair extend generally parallel to the respective wedge faces with which they engage.

13. A wall arrangement according to claim 11, wherein the grooves defining the other opposed pair have the wedge faces thereof projecting horizontally in oppositely angled relation relative to the horizontal widthwise direction, and wherein the wedge faces defined on the pair of grooves defined on each said edge rail extend horizontally in oppositely angled direction relative to the horizontal widthwise direction.

14. A wall arrangement according to claim 13, wherein each said wedge surface is substantially parallel to the wedge face with which it is engaged.

15. An interior upright floor-to-ceiling wall arrangement, comprising:

at least first and second upright wall panels for supportive disposition on a floor and having a height which extends substantially to a ceiling and a width which extends horizontally, said first and second panels being positioned in adjacent and upright relationship so that the first and second panels are horizontally aligned in a widthwise direction thereof;

said first and second panels having respective first and second elongate upright edge rails disposed in closely adjacent but opposed relationship, said edge rails defining thereon edge faces of said panels which are in adjacent but opposed facing relationship;

a plurality of vertically spaced connector assemblies positioned horizontally between and fixedly but releasably engaged with said first and second edge rails for fixedly connecting said first and second panels together in said horizontally aligned widthwise direction;

each of said first and second edge rails having a pair of parallel elongate grooves disposed in sidewardly spaced relation and extending vertically along said rails and having a mouth opening outwardly of the respective edge face, the mouth of one of said grooves on said first edge rail being disposed horizontally opposite and substantially aligned with the mouth of one of the grooves on said second edge rail;

the pair of grooves of each said edge rail, as the grooves open inwardly from the respective edge face, defining a pair of oppositely sidewardly facing wedge faces which extend inwardly in angled relationship to one another, said connector assembly including a connector member positioned between the horizontally opposed edge faces of said first and second panels and elongated horizontally in a thickness direction of the panels;

said connector assembly including a pair of transversely enlarged gripping members carried on said connector member in spaced relationship therealong, said gripping member being joined to said connector member by oppositely-handed threaded connections so that rotation of said connector member about its elongate axis causes the pair of gripping members to both move longitudinally in opposite directions relative to said connector member;

each said gripping member having a pair of wedge plates cantilevered outwardly from opposite sides thereof and defining thereon a pair of wedge surfaces which are in angled relationship to one another and engage said wedge faces defined on said grooves, said wedge surfaces and said wedge faces all being angled horizontally relative to said horizontal widthwise direction at an acute angle;

said connector member having a tool-engaging part defined at one end thereof for engagement with a tool insertable between the opposed edge faces for effecting rotation of the connector member;

whereby the connector assembly is positioned between the opposed edge faces of the first and second edge rails so that the wedge plates project into the pairs of opposed grooves, and rotation of the connector member causes the wedge plate to move lengthwise in opposite directions relative to the connector member so that the wedge surfaces engage the wedge faces and simultaneously cause the first and second panels to be aligned as they are drawn together.

16. A wall arrangement according to claim 15, including horizontally projecting stop elements cooperating between said connector member and the edge faces of said first and second edge rails for limiting the aligned inward drawing of the first and second panels toward one another.

17. A wall arrangement according to claim 16, wherein the stop elements are defined by a pair of sidewardly spaced but substantially parallel ribs which are vertically elongate along the edge face and which are formed on each said edge rail and project horizontally outwardly away from the respective edge face for contacting engagement with said connector member when the panels are tightly drawn together.

18. A wall arrangement according to claim 15, wherein each said wedge plate includes a generally flat center plate part which is threadably engaged with the rod, and also includes sloped wedge plate parts which are cantilevered outwardly in angled relation from opposite sides of the center plate part so that the wedge plate has a shallow channel-like horizontal cross section, and the channel-like horizontal cross section of said first and second wedge plates being oppositely oriented relative to the lengthwise direction of said rod.

19. A wall arrangement according to claim 15, wherein the wedge surfaces and the wedge faces are all angled horizontally relative to said horizontal widthwise direction at said acute angle which is about 30° C.

20. An interior upright wall arrangement, comprising:

at least first and second upright wall panels for supportive disposition on a floor, said first and second panels being positioned in adjacent and upright relationship so that the first and second panels are horizontally aligned in a widthwise direction thereof;

said first and second panels having respective first and second elongate upright edge rails defining thereon edge faces which are disposed in adjacent but opposed facing relationship to define a small space therebetween;

a plurality of vertically spaced connector assemblies positioned horizontally in said space between and fixedly but releasably engaged with said first and second edge rails for fixedly connecting said first and second panels together in said horizontally aligned widthwise direction;

each of said first and second edge rails having a pair of parallel elongate grooves disposed in sidewardly spaced relation and extending vertically along said rails and having a mouth opening outwardly of the respective edge face, the mouth of one of said grooves on said first edge rail being disposed horizontally opposite and substantially aligned with the mouth of one of the grooves on said second edge rail;

the pair of grooves of each said edge rail, as the grooves open inwardly from the respective edge face, defining a pair of oppositely sidewardly facing wedge faces which extend inwardly in angled relationship to one another;

said connector assembly including a connector member positioned between the horizontally opposed edge faces of said first and second panels and elongated horizontally in a thickness direction of the panels;

said connector assembly including a pair of transversely enlarged gripping members carried on said connector member in spaced relationship therealong so that rotation of said connector member about its elongate axis causes the pair of gripping members to both move longitudinally in opposite directions relative to said connector member;

each said gripping member having a pair of wedge plates cantilevered outwardly from opposite sides thereof and defining thereon a pair of wedge surfaces which are in angled relationship to one another and engage said wedge faces defined on said grooves;

whereby the connector assembly is positioned between the opposed edge faces of the first and second edge rails so that the wedge plates project into the pairs of opposed grooves, and rotation of the connector member causes the wedge plate to move lengthwise in opposite directions relative to the connector member so that the wedge surfaces engage the wedge faces and simultaneously cause the first and second panels to be aligned as they are drawn together.

* * * * *